United States Patent [19]

Rico

[11] 4,325,159

[45] Apr. 20, 1982

[54] PAINT DRIP CATCHER

[76] Inventor: Laureano P. Rico, 29 Crimson Ave., Malverne, N.Y. 11565

[21] Appl. No.: 139,277

[22] Filed: May 1, 1980

[51] Int. Cl.[3] ..... B05C 21/00

[52] U.S. Cl. ..... 15/248 A

[58] Field of Search ..... 15/230.11, 248 R, 248 A; 29/110.5; 101/328, 329, 330, 331; 401/197, 208, 218, 219, 220

[56] References Cited

U.S. PATENT DOCUMENTS

| | | | |
|---|---|---|---|
| 2,160,570 | 5/1939 | Welt | 15/248 A X |
| 2,896,244 | 7/1959 | Crosh | 15/248 A |
| 3,538,532 | 11/1970 | Shortino et al. | 15/248 A X |

FOREIGN PATENT DOCUMENTS

| | | | |
|---|---|---|---|
| 547401 | 5/1956 | Belgium | 15/248 A |

*Primary Examiner*—Chris K. Moore

*Attorney, Agent, or Firm*—Howard C. Miskin

[57] ABSTRACT

A paint roller guard attachment for preventing the splattering of paint onto the painter's face and eyes is integrally formed of resilient deformable sheet metal and includes a longitudinally extending tubular coupling section having a bottom longitudinal slot bordered by depending arms each of which is integrally joined at its bottom in an upwardly convex cylindrical inner wing section joining an outwardly concave outer wing section. The lower transverse cross arm of a paint roller releasably engages the guard coupling sections and when the assembly is employed in painting a ceiling the wing members project laterally outwardly to a fully extended position and when employed in painting walls the wings are folded downwardly toward the roller handle and pushed into slots in the handle to retain the wings in retracted partially collapsed condition. Where the paint roller is of the type including an inclined lower arm an adapter is provided with a split tube engaging the inclined arm and a laterally extending tubular section for releasably engaging the guard coupling section.

8 Claims, 5 Drawing Figures

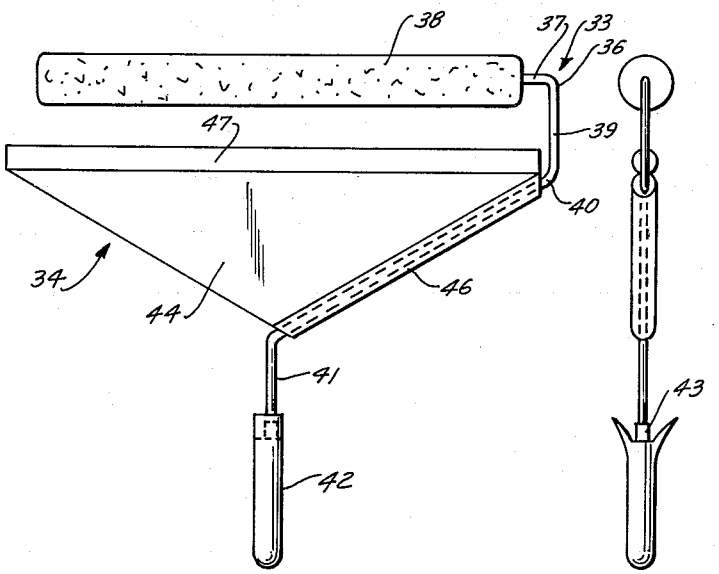
FIG. 5
FIG. 4
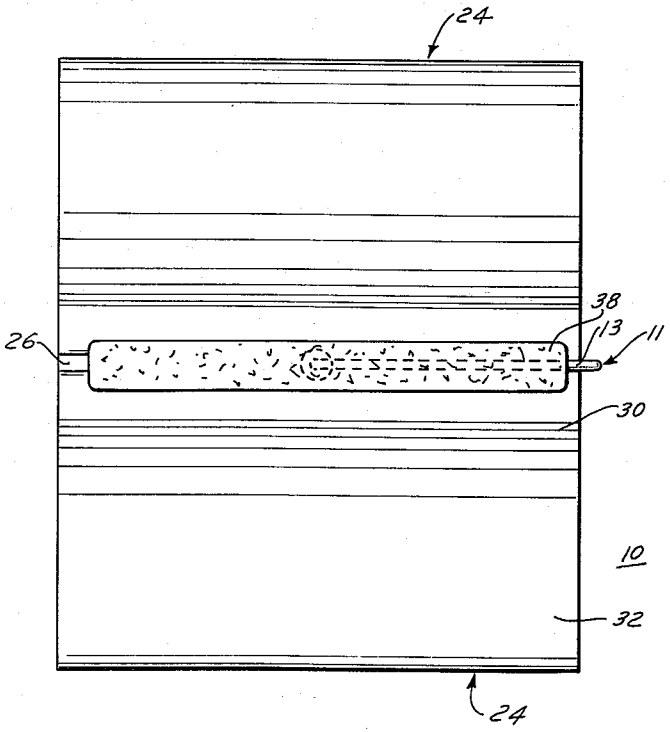
FIG. 3

PAINT DRIP CATCHER

BACKGROUND OF THE INVENTION

The present invention relates generally to improvements in paint applicators and it relates more particularly to an improved shield or guard for attachment to a applicator roller.

It is a common practice in the application of paint to walls, ceilings and other surfaces by means of a paint applying roller to attach a guard or a shield to the roller to prevent the splattering and dripping of the paint from the roller during its use onto the operator, particularly onto his face and eyes or onto areas which are to be unpainted. However, the paint roller shields heretofore available or proposed posess numerous drawbacks and disadvantages. It has been found that the roller application of paint onto a wall or ceiling presents different problems in the application of the paint applying roller and in the paint drip and splattering so that a type of shield suitable for one surface is unsuitable for another surface. The earlier paint roller shields are moreover of little versitility and adaptability, unreliable, frequently complex and difficult to apply and otherwise leave much to be desired.

SUMMARY OF THE INVENTION

It is a principal object to provide an improved paint applicator device.

Another object of the present invention is to provide an improved guard or shield for attachment to a paint applicator roller to catch splatter and drip from the paint roller when used on ceilings walls or other surface and to prevent such splatter or drip from reaching the operator or other unwanted surfaces and particularly to prevent any paint from splattering onto the face and eyes of the painter.

Still another object of the present invention is to provide an improved paint applying roller shield which is adjustable for optimum operation on differently oriented surfaces such as ceilings, vertical walls and other surfaces.

A further object of the present invention is to provide an improved shield which is easily applied to and detached from conventional paint applying rollers.

Still a further object of the present invention is to provide a device of the above nature characterized by its simplicity, reliability, low cost and great versitility and adaptability.

The above and other objects of the present invention will become apparent from a reading of the following description taken in conjunction with the accompanying drawings which illustrate preferred embodiments thereof.

A paint applying roller shield device in accordance with the present invention includes a pair of oppositely laterally projecting wing sections which are rearwardly swingable to a retracted position retaining means for releasably locking the wing sections in their retracted position and coupling means for releasably attaching the device to a paint applying roller component.

In its preferred form the improved shield member is integrally formed of a resilient flexible sheet such as of thin iresiliently deformable sheet metal and includes a medial tubular section longitudinally split along its rear and defining the shield coupling means, a pair of parallel walls projecting rearwardly from opposite edges of the slit with each being joined along its rear edge to a laterally undulate wing including a forwardly cylindrically convex inner section and a forwardly concave outer section, the inner front face of the inner section being spaced from the confronting face of the adjacent rearwardly projecting wall. The wing locking means is defined by forwardly open notches or recesses formed in the handle of the paint applying roller to which the shield is coupled, the wings, in their contracted condition being swung rearwardly to bring their medial outer edges into engagements with the handle notches.

The improved shield functions to reliably prevent any paint from splattering onto the face and eyes and other parts of the operator and the shield is rugged, simple and inexpensive, is easy to attach to a roller and to adjust for differently oriented surfaces to be painted and is highly versitile and adaptable.

BRIEF DESCRIPTION OF THE DRAWINGS

FIG. 3 is a top plan view thereof;

FIG. 4 is a front elevational view of a paint applying roller to which an adapter is applied for attachment to the shield of FIGS. 1 to 3; and FIG. 5 is an end elevational view thereof.

DESCRIPTION OF THE PREFERRED EMBODIMENTS

Figure 2:
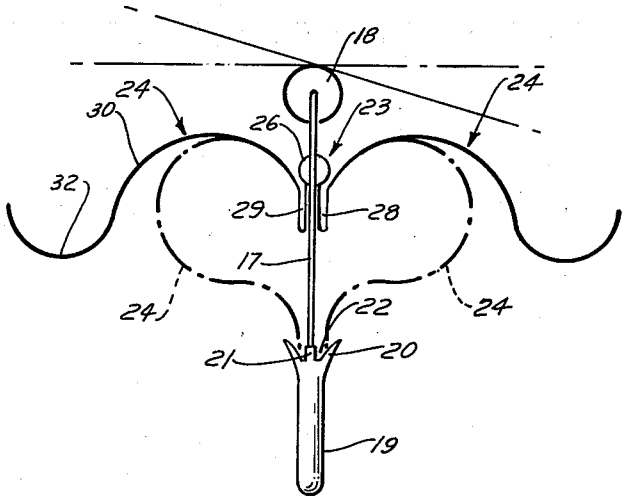
FIG. 2 is an end elevational view thereof with the shield being shown by broken line in its retracted position.
Figure 1:
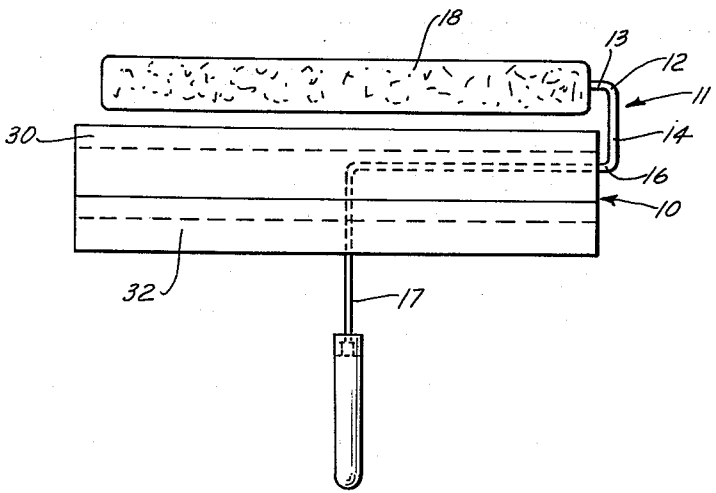
FIG. 1 is a front elevational view of a shield embodying the present invention illustrated attached to a paint applying roller and in the shield extended position.

Referring now to the drawings, particularly FIGS. 1 to 3 thereof which illustrate a preferred embodiment of the present invention, the reference numeral 10 generally designates the improved paint splatter and drip shield which is illustrated as applied to a paint applying roller 11 of substantially conventional construction.

The paint applying roller 11 comprises a bent metal rod frame 12 including an upper or forward transversely extending axle defining arm 13 terminating at one end with a depending leg 14 which at its bottom joins a lower arm 16 parallel to upper arm 13 and of approximately half its length. Depending from the inner end of arm 16 is a medial vertical 17. Journalled to and freely rotatable on the upper arm 13 is a paint applicator roller member 18, per se, which is spaced from leg 14 and above arm 16.

A handle member 19 preferrably molded of a synthetic organic polymeric resin composition depends from the leg 17 which is imbedded in and attached to the leg 17. The handle member 17 is of any suitable shape and is provided at its top sides with an upwardly diverging pair of tapered ears or wings 20 whose inner faces define with the respective confronting faces of leg 17 or a medial post 21 formed on the top of handle member 19 locking or retaining notches 22.

The shield 10 is integrally formed as a unit of a deformable, resilient flexible thin sheet which may be metal or a thermoplastic synthetic organic resin composition and includes a longitudinally extending medial coupling section 23 and a pair of oppositely laterally projecting transversely undulate resiliently flexible wing sections 24 extending from coupling section 23. The coupling section 23 comprises a longitudinally extending tubular portion 26 having on its bottom and extending for the full length thereof a longitudinal slot 27. Depending from the opposite edges of slot 27 is a pair of laterally spaced parallel walls 28 which are joined at their bottoms by curved junctions to walls 29 which extend upwardly parallel to walls 28 and are substantially equal to the lengths thereof.

Joined to the upper edges of walls 29 and projecting laterally outwardly therefrom are cylindrically upwardly convex wing inner sections 30 which are joined at their outer edges to cylindrically upwardly concave wing outer sections 32. In the extended positions of wings 24 as shown by full line in FIG. 2 the wings 24 project laterally with the uppermost faces of wing inner sections 30 being somewhat above coupling section 23 and the wing outer sections 32 being slightly below the coupling section. In the constructed condition of wings 30, as shown by broken line in FIG. 2, the wings are resiliently deformed and the outer borders of outer wing sections 32 engage handle notches 22 to releasably retain in the wings 24 in their contracted position which together formed an approximately heart shaped loop symmetrical to the medial vertical axis.

In attaching the shield 10 to the paint applying roller 12 the roller frame arm 16 is raised between walls 28 and slid longitudinally until the arm 17 is medially disposed as shown in FIG. 2, the arm 16 registering with tubular section 26. In the coupled condition of roller 11 and shield 11 the roller member 18 is located above the uppermost surface of the shield 10. The shield when the roller is used in painting the ceiling is advantageously in its normal self resiliently fully extended position as shown by full line in FIG. 2 and when used in painting vertical walls, the shield is advantageously contracted, as shown by broken line in FIG. 2 and releasably retained in such contracted condition by bringing the outer borders of wings 24 into engagement with handle notches 22. The shield can be returned to its expanded condition by raising the borders of the wings 24 out of engagement with notches 22 and permiting the wings to resiliently return to their expanded positions.

When a paint applying roller 33 of the type illustrated in FIGS. 4 and 5 is to be used with the improved shield 10 an adapter member 34 is provided. The roller 33 is similar in construction to the roller 11 except in the configuration of the bent rod frame 36 which includes an upper horizontal arm 37 which supports the roller member 38 and terminates at one end in a depending leg 39 which is joined by an inwardly downwardly inclined arm 40 terminating in a depending medial leg 41 anchored to a handle member 42 similar in construction to handle member 19 and provided with retaining notches 43.

The adapter member 34 is formed of sheet material and includes an isosceles triangular body member 44 with a depending medial apex. One of the inclined borders of body member 44 is formed into an elongated tube 46 which engages the frame inclined arm 40 and the horizontal border of body member 44 is likewise formed into an elongated horizontal tube 47 which is adapted to separably engage the coupling tube 26 of the shield 10 in the manner of frame arm 16 as earlier explained.

The paint applying roller 33 and adapter member 34 operate with the shield 10 in the manner described in connection with paint applying roller 11.

While there have been described and illustrated preferred embodiments of the present invention it is apparent that numerous alterations, omissions and additions may be made without departing from the spirit thereof.

What is claimed is:

1. A paint applicator roller shield device comprising a pair of wing members formed of resilient flexible sheet material and being movable between oppositely laterally projecting extended positions and rearwardly extending contracted positions and in their normal unstressed condition being in said extended positions and in their contracted positions being rearwardly deformed, means releasably engaging the outer border of said wing members in their rearwardly contracted positions for releasably retaining said wing member in said contracted positions and means for separably attaching said pair of wing members to a paint applicator roller.

2. The device of claim 1 wherein said wing members and said attaching means are integrally formed and said attaching means is positioned intermediate of and joins said wing members.

3. The shield device of claim 1 wherein each of said wing members is laterally undulate and includes an inner forwardly convex cylindrical section and an outer forwardly concave cylindrical section.

4. The shield device of claim 3 wherein said attaching means includes a longitudinally extending tubular section disposed between and joined to said wing members and being longitudinally open along its rear.

5. The shield device of claim 4 including first walls extending rearwardly from the edges delineating said tubular longitudinal opening and second walls projecting forwardly from the rear edges of said first walls and joining the inner edge of said wing members.

6. In combination with the shield device of claim 4, a paint applicator roller comprising a frame member including a horizontal front arm rotatably supporting a roller, a rear arm spaced rearwardly from and connected to said front arm and terminating in a rearwardly projecting leg and a handle attached to said leg, said rear arm separably engaging said tubular section and said handle having notch defining portions defining said retaining means and releasably engaging the outer edges of the contracted wing members.

7. In combination with the shield device of claim 4, a paint applicator roller comprising a frame member including a front arm rotatably supporting a roller and a diagonal arm extending inwardly rearwardly and connected to an end of said front arm and terminating in a rearwardly projecting leg, and an adapter member including a body member having a cylindrical front edge releasably engaging said shield tubular section and a tubular diagonal edge engaging said frame diagonal arm.

8. A paint applicator roller shield device comprising a pair of wing members formed of flexible resilient sheet material and deformably movable between oppositely laterally projecting extended positions and rearwardly extending contracted positions, means for releasably retaining said wing members in a resiliently deformed condition in one of said extended and contracted positions and means integrally formed with and positioned between said wing members for separably attaching said pair of wing members to a paint applicator roller.

* * * * *